US007736277B2

(12) United States Patent
Nakanishi

(10) Patent No.: US 7,736,277 B2
(45) Date of Patent: Jun. 15, 2010

(54) ROCKING TYPE EXERCISING APPARATUS

(75) Inventor: Ryusuke Nakanishi, Nagoya (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 12/230,478

(22) Filed: Aug. 29, 2008

(65) Prior Publication Data

US 2009/0062090 A1 Mar. 5, 2009

(30) Foreign Application Priority Data

Mar. 31, 2007 (JP) ..... 2007-227189

(51) Int. Cl.
*A63B 22/00* (2006.01)

(52) U.S. Cl. ..... 482/51; 482/146; 482/147; 472/95; 472/97; 472/102; 434/247

(58) Field of Classification Search ..... 482/51, 482/146–147; 472/102–103, 95–97, 27, 472/29; 434/247
See application file for complete search history.

(56) References Cited

U.S. PATENT DOCUMENTS 5,085,425 A * 2/1992 Collins et al. ..... 472/97
2006/0073940 A1* 4/2006 Nakanishi ..... 482/51

FOREIGN PATENT DOCUMENTS

| | | |
|---|---|---|
| DE | 199 12 281 | 10/2000 |
| EP | 0 407 158 | 1/1991 |
| JP | 11-004911 | 1/1999 |
| JP | 2001-286578 | 10/2001 |
| JP | 2004-173865 | 6/2004 |
| JP | 2006-101982 | 4/2006 |
| JP | 2007-167289 | 7/2007 |

* cited by examiner

*Primary Examiner*—Loan H Thanh
*Assistant Examiner*—Shila Abyaneh
(74) *Attorney, Agent, or Firm*—Bacon & Thomas, PLLC

(57) ABSTRACT

A rocking type exercising apparatus includes a movable unit on which a user rides and a driving unit for causing the movable unit to perform a rocking motion. The driving unit is designed to drive the movable unit to rock in forward/backward directions of the user riding on the movable unit and to move the movable unit forward at a greater acceleration than when the movable unit is moved backward.

7 Claims, 11 Drawing Sheets

ROCKING TYPE EXERCISING APPARATUS

FIELD OF THE INVENTION

The present invention relates to a rocking type exercising apparatus for providing a user with an exercising effect similar to a horse riding by rocking a seat on which the user sits and for urging the user to maintain a balance by rocking treadles on which the user straddles.

BACKGROUND OF THE INVENTION

A rocking type exercising apparatus for providing a user with an exercising effect similar to a horse riding is an easy-to-use exercising apparatus that is widely used among users of various generations from children to elderly persons and is spread to general households as well as rehabilitation purpose medical facilities. Examples of the conventional rocking type exercising apparatus are disclosed in, e.g., Japanese Patent No. 3394890 and Japanese Patent Laid-open Application No. 2001-286578.

Japanese Patent No. 3394890 discloses a prophylactic training apparatus for lumbago that can realize rhythmical rocking motions using a parallel mechanism having a leeway of movement in six different directions or the like. Japanese Patent Laid-open Application No. 2001-286578 discloses a balance training apparatus that can realize a forward/backward rocking motion and a leftward/rightward rocking motion using a motor and a link.

The conventional apparatus noted above are designed to simulate the rocking motion of a user's body generated when riding on a horseback but take no account of the advancing movement resulting from the walking of a horse. Assuming that the afore-mentioned apparatus would make a user feel as if he or she moves forward, it will be possible to provide a more realistic exercise effect to the user.

SUMMARY OF THE INVENTION

In view of the above, the present invention provides a rocking type exercising apparatus capable of giving a sense of forward movement to a user in addition to a rocking motion.

In accordance with the present invention, there is provided a rocking type exercising apparatus including: a movable unit on which a user rides; and a driving unit for causing the movable unit to perform a rocking motion, wherein the driving unit is designed to drive the movable unit to rock in forward/backward directions of the user riding on the movable unit and to move the movable unit forward at a greater acceleration than when the movable unit is moved backward.

With the present rocking type exercising apparatus, the forward motion made with greater acceleration than the backward motion gives a sense of realistic forward movement to a user despite the fact that the apparatus is reciprocatingly moved in a forward/backward direction.

In the present rocking type exercising apparatus, the driving unit may be designed to rock the movable unit by using eccentric rotational output power and to set an acceleration difference between forward movement and backward movement by using eccentric rotation. It may be possible to attain the acceleration difference by changing the rotational speed of a motor of the driving unit.

Although the rocking type exercising apparatus of the present invention is designed to merely perform forward/backward reciprocating motions, the user who rides on the movable unit and rocks with the movable unit can feel a sense of realistic forward movement because the acceleration at the forward motion is greater than that at the backward motion. Therefore, if the apparatus provides similar effects as a horse riding, it is possible for the user to feel a bodily sensation analogous to actual horse riding.

BRIEF DESCRIPTION OF THE DRAWINGS

The object and features of the present invention will become apparent from the following description of embodiments given in conjunction with the accompanying drawings, in which.

DETAILED DESCRIPTION OF THE EMBODIMENT

Hereinafter, an exemplary embodiment of the present invention will be described with reference to FIGS. 1 to 11, which form a part hereof.

Figure 2:
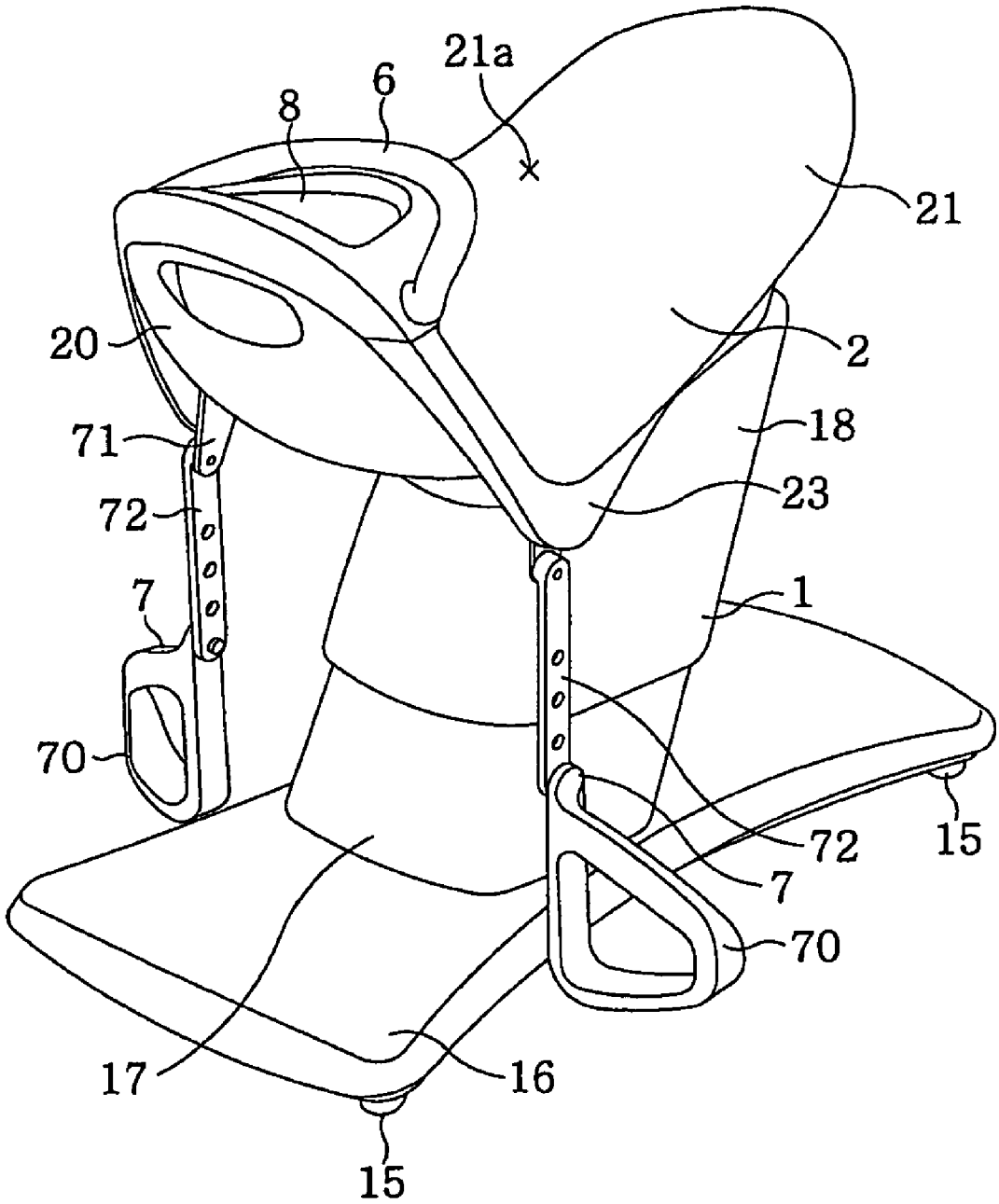
FIG. 2 is a perspective view of the rocking type exercising apparatus.
Figure 3A:
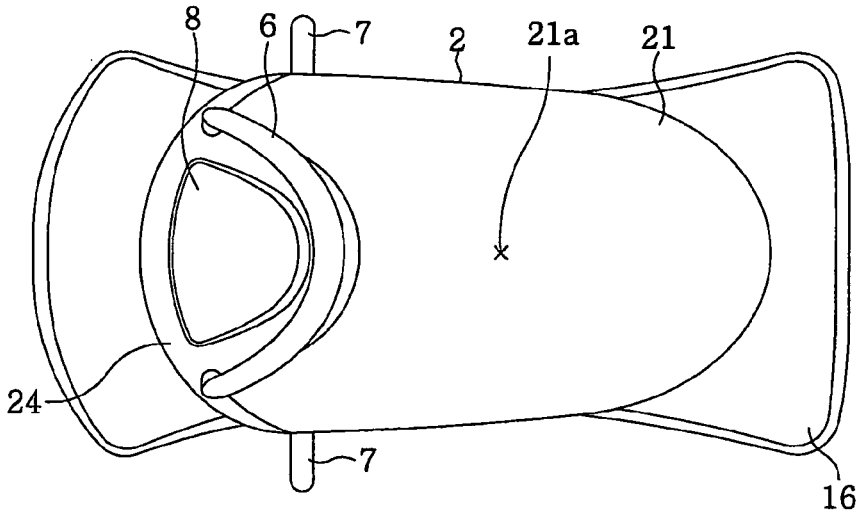
FIGS. 3A and 3B are top plan and right side views of the rocking type exercising apparatus.
Figure 3B:
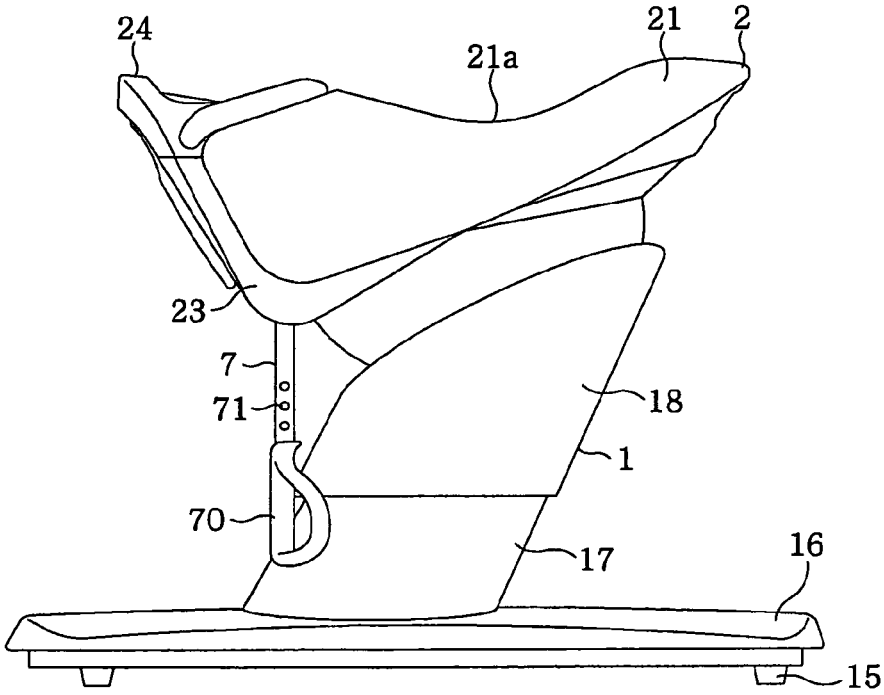
Figure 4:
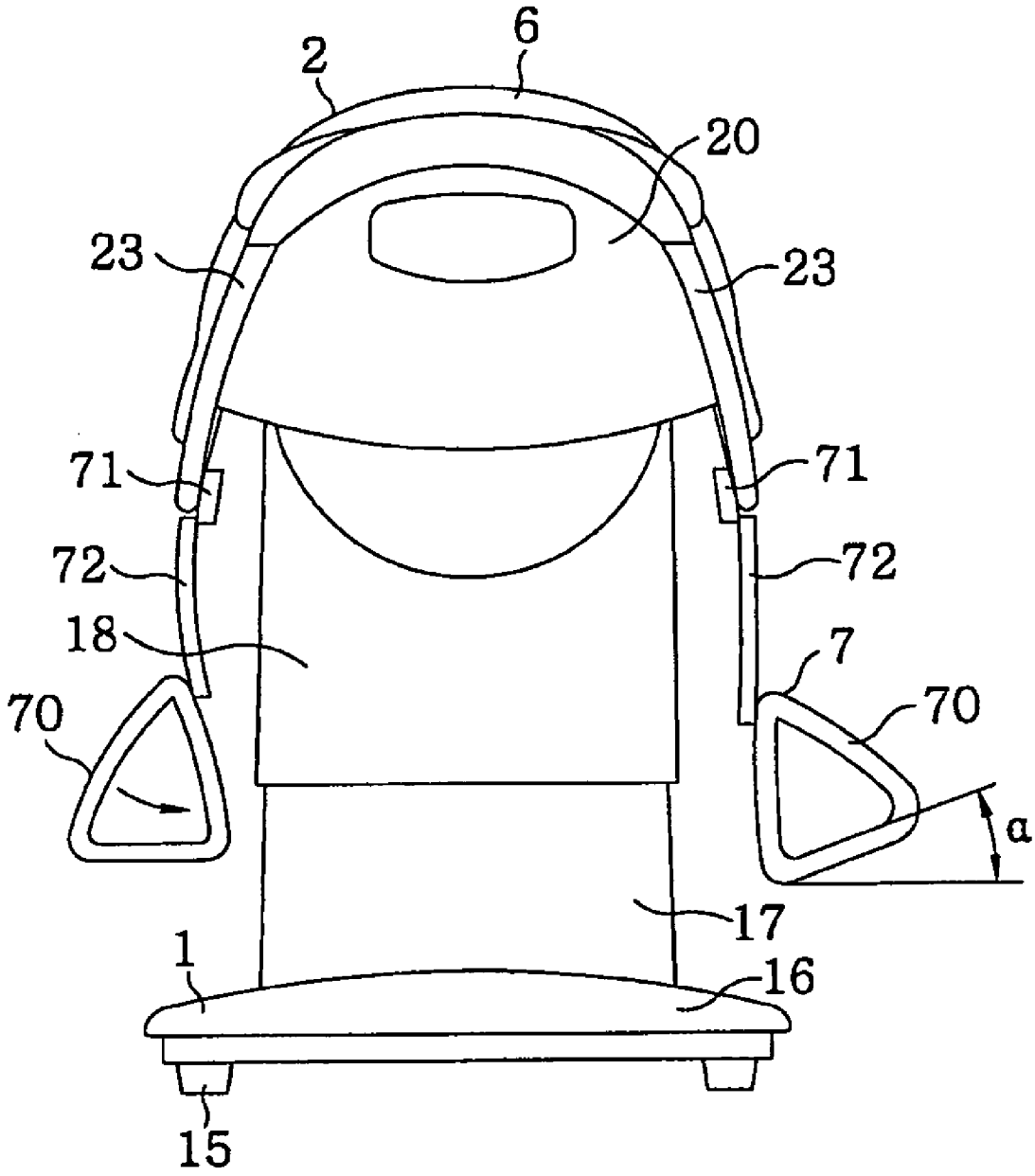
FIG. 4 is a front view of the rocking type exercising apparatus.

The rocking type exercising apparatus shown in FIGS. 2 and 3 is designed to cause forward/backward and leftward/rightward rocking motions to a seat 2 on which a user sits, so that the user sitting on the seat 2 can take an exercise for balance training purposes. The rocking type exercising apparatus includes a seat 2 imitating a horseback or a saddle in shape and having a top seat surface, a driving unit 3 for causing a rocking motion to the seat 2 and a main body 1 for receiving the driving unit 3 within an upper portion thereof. A generally semicircular arc-shaped rein 6 is connected at its opposite ends to the front end side of the seat 2 in a manner that the rein 6 is pivotably moved in the forward/backward direction. An operation panel 8 is also provided on the front end side of the seat 2. Stirrup members 7 and 7 are suspended from the opposite flanks of the seat 2 near the front end of the latter.

Figure 5:
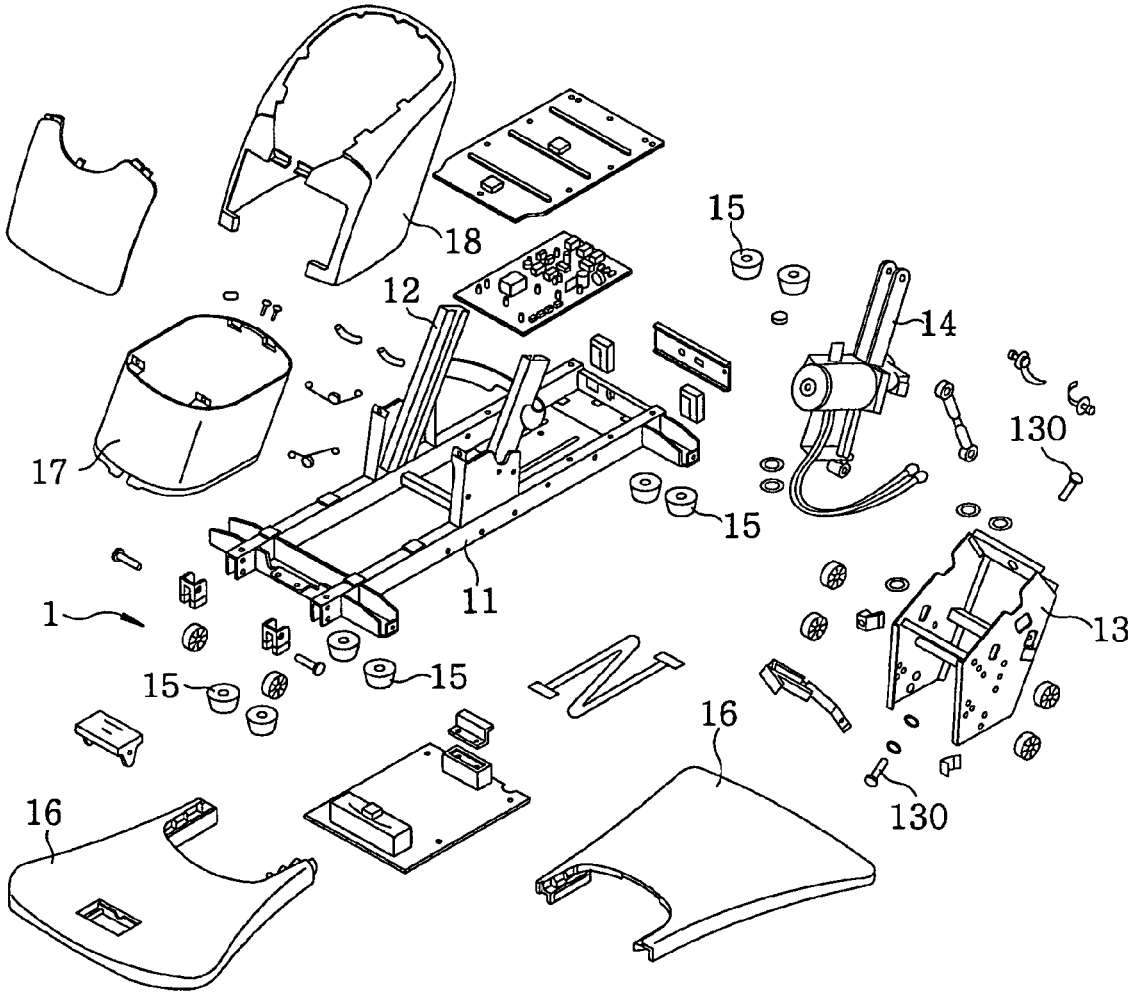
FIG. 5 is an exploded perspective view showing a main body unit of the rocking type exercising apparatus.

As can be seen in FIG. 5, the main body 1 includes a base frame 11 having ground-contacting legs 15 at its four corners, a post 12 extending upwardly and rearwardly from the generally central portion of the base frame 11, a support frame 13 attached to the post 12 in a manner that the support frame 13 is slidably movable in the longitudinal direction of the post 12 and an electrical sliding unit 14 for performing the sliding movement of the support frame 13 with electric power. The main body 1 further includes a base cover 16 for covering the upper surface of the base frame 11, a cover 17 for covering the vicinity of the post 12, and a main cover 18 for covering the outer circumference of the support frame 13.

Figure 6:
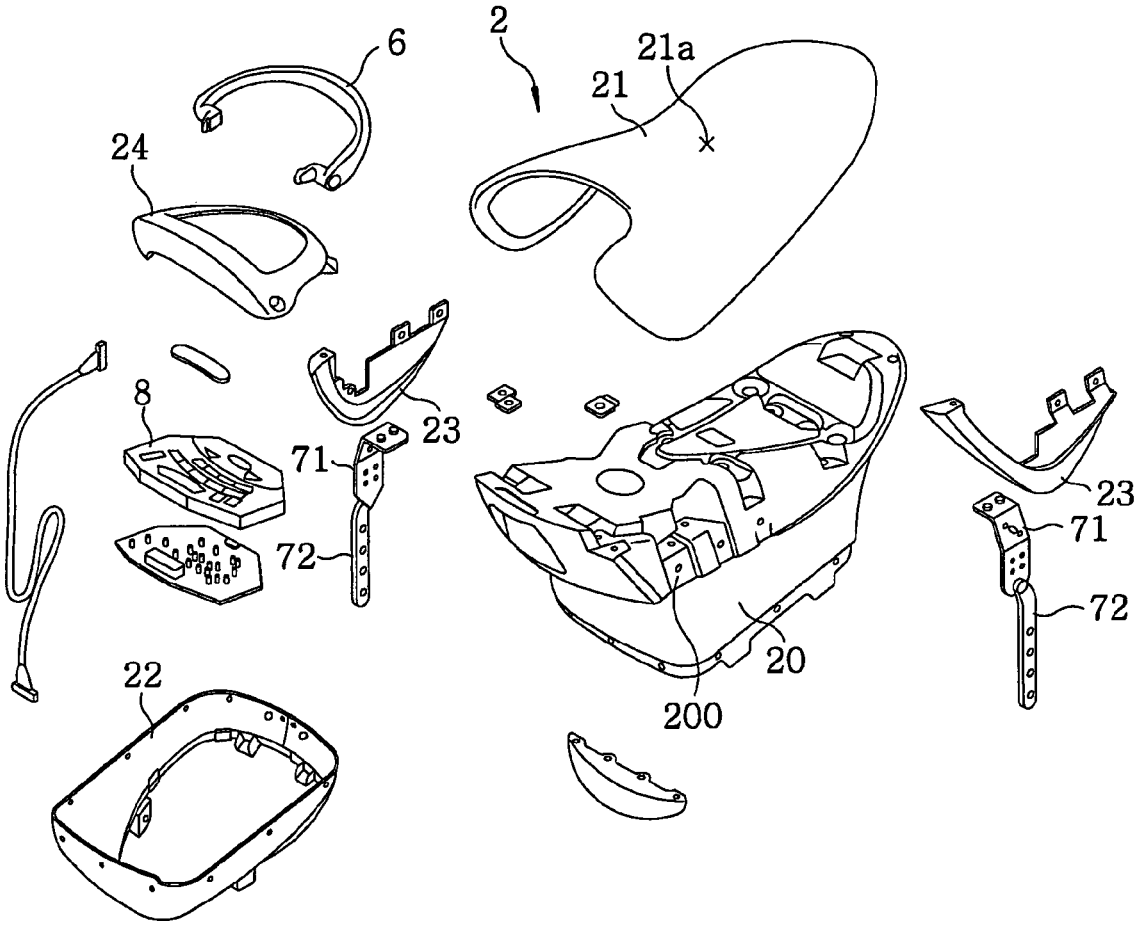
FIG. 6 is an exploded perspective view showing a seat of the rocking type exercising apparatus.
Figure 7:
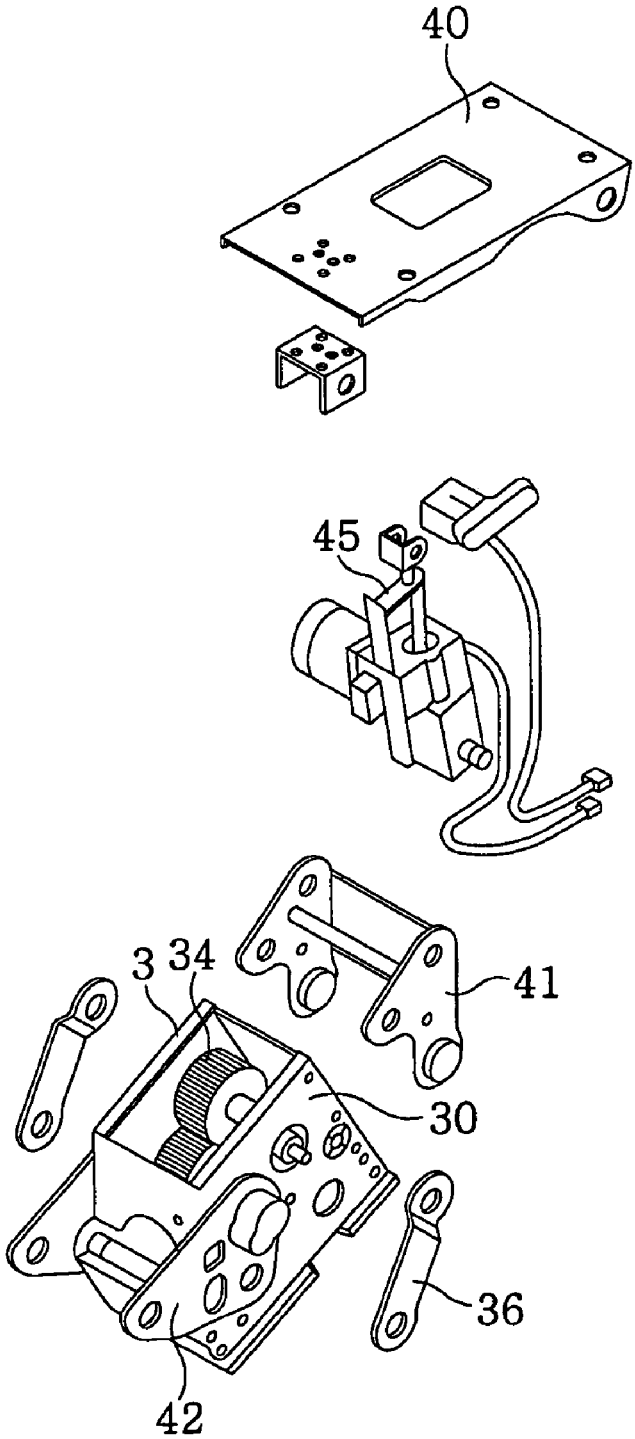
FIG. 7 is an exploded perspective view showing a driving unit of the rocking type exercising apparatus.
Figure 8:
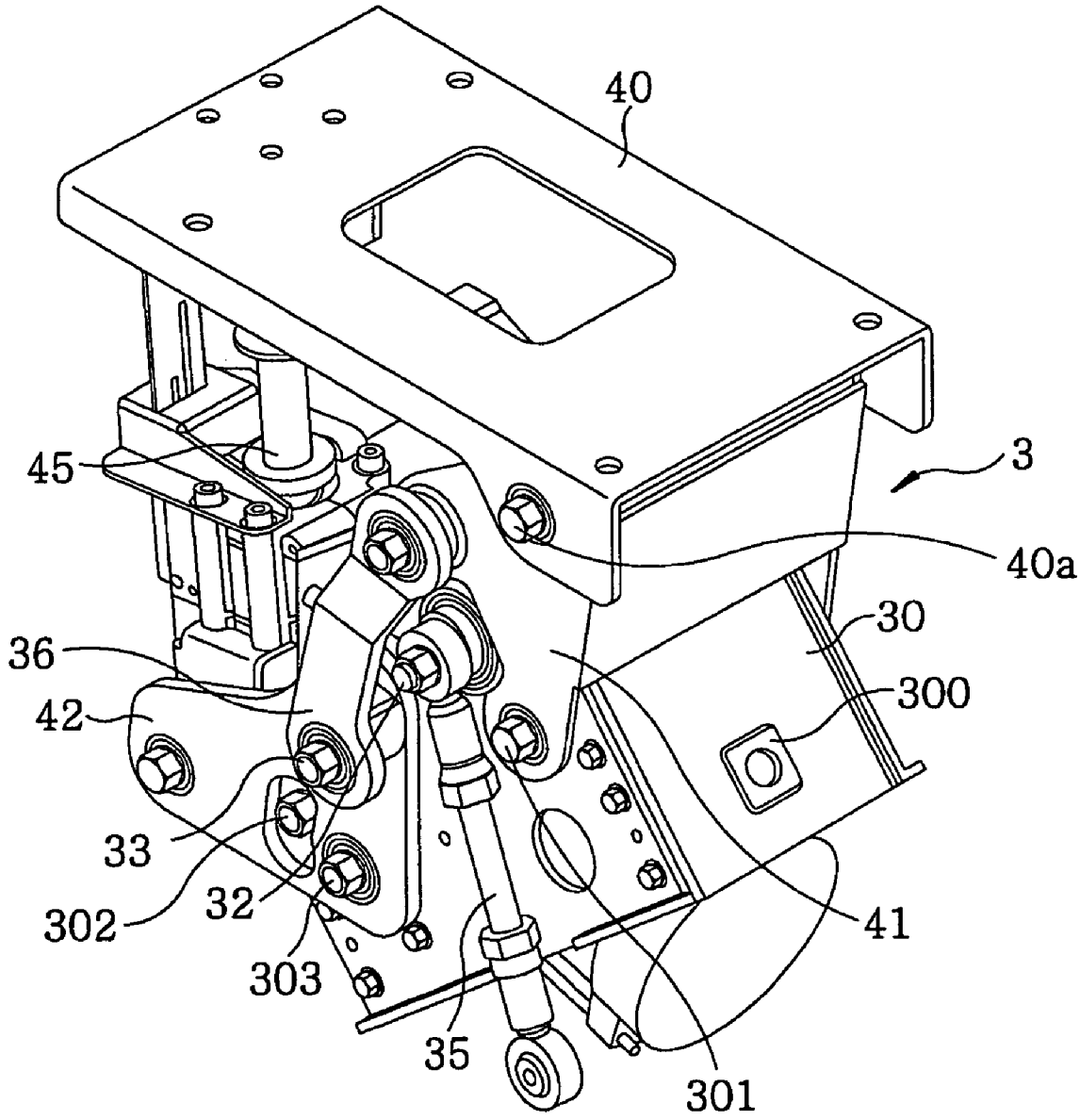
FIG. 8 is a perspective view of the driving unit of the rocking type exercising apparatus.

Referring to FIG. 6, the seat 2 includes a seat frame 20, a seat surface member 21 attached to the upper surface of the seat frame 20, a cover 22 joined to the lower side of the seat frame 20, a pair of protection covers 23 attached to the left and right sides of the seat frame 20, and a panel cover 24 for covering the vicinity of the operation panel 8.

Each of the stirrup members 7 includes a fixed piece 71 fixedly secured to a stirrup attachment portion 200 formed on each side surface of the seat frame 20, a connection piece 72 suspended from the fixed piece 71, and a foot rest 70 suspended from the connection piece 72. Each of the protection covers 23 covers the outer end of a joint pin portion by which the connection piece 72 is joined to the fixed piece 71, thereby preventing a possibility that the knee portion of the user sitting on the seat 2 comes into contact with the joint pin portion.

The driving unit 3 will now be described. Referring to FIGS. 7 to 10, the driving unit 3 includes a movable frame 30 formed into a box-like shape, a motor 31 arranged within the movable frame 30, a gear group 34 arranged within the movable frame 30 for transferring the torque of the motor 31 to a couple of output shafts 32 and 33, a movable plate 40 positioned above the movable frame 30, and two kinds of link plates 41 and 42 for connecting the movable plate 40 to the movable frame 30. The gear group 34 serves as a speed reduction means which reduces a rotational speed of the motor. The movable frame 30 has bearing portions 300 at its front and rear end surfaces. The bearing portions 300 of the movable frame 30, are rotatably attached to the support frame 13 of the main body 1 by respective shafts 130 (shown in FIG. 5), so that the movable frame 30 swings in the leftward and rightward directions about the shafts 130.

In this regard, the link plate 41 connected to the rear end side of the movable plate 40 is coupled to the rear side surfaces of the movable frame 30 by means of a shaft 301. A rotating plate 39 is arranged within the movable frame 30 and is supported at one end by the movable frame 30 by means of a shaft 302. The link plate 42 is supported by the other end of the rotating plate 39 by means of a shaft 303. Furthermore, the link plate 42 is connected to the front end of the movable plate 40 through an extensible/contractible actuator 45.

The two output shafts 32 and 33 are pivotably driven, of which the output shaft 32 has an off-centered portion lying on the external surface of the movable frame 30. The off-centered portion is connected to the support frame 13 through a link 35.

The output shaft 33 has two off-centered portions 33*a* and 33*b* lying on the external surface of the movable frame 30. The off-centered portion 33*a* with reduced eccentricity is connected to the link plate 42, while the off-centered portion 33*b* with increased eccentricity is connected to one end of a connection link 36 of which the other end is connected to the link plate 41.

Figure 9:
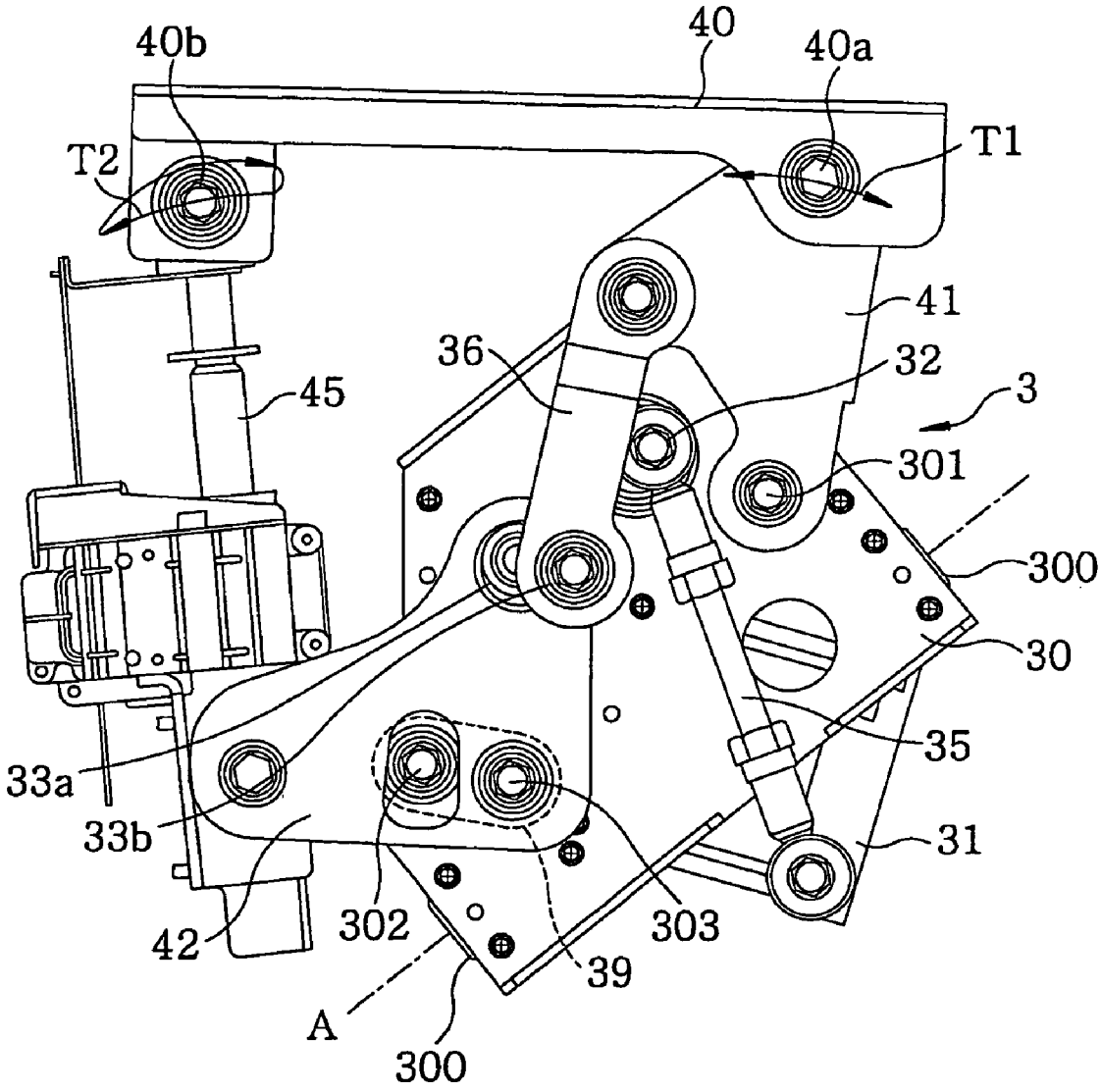
FIG. 9 is a side view of the driving unit of the rocking type exercising apparatus.
Figure 10:
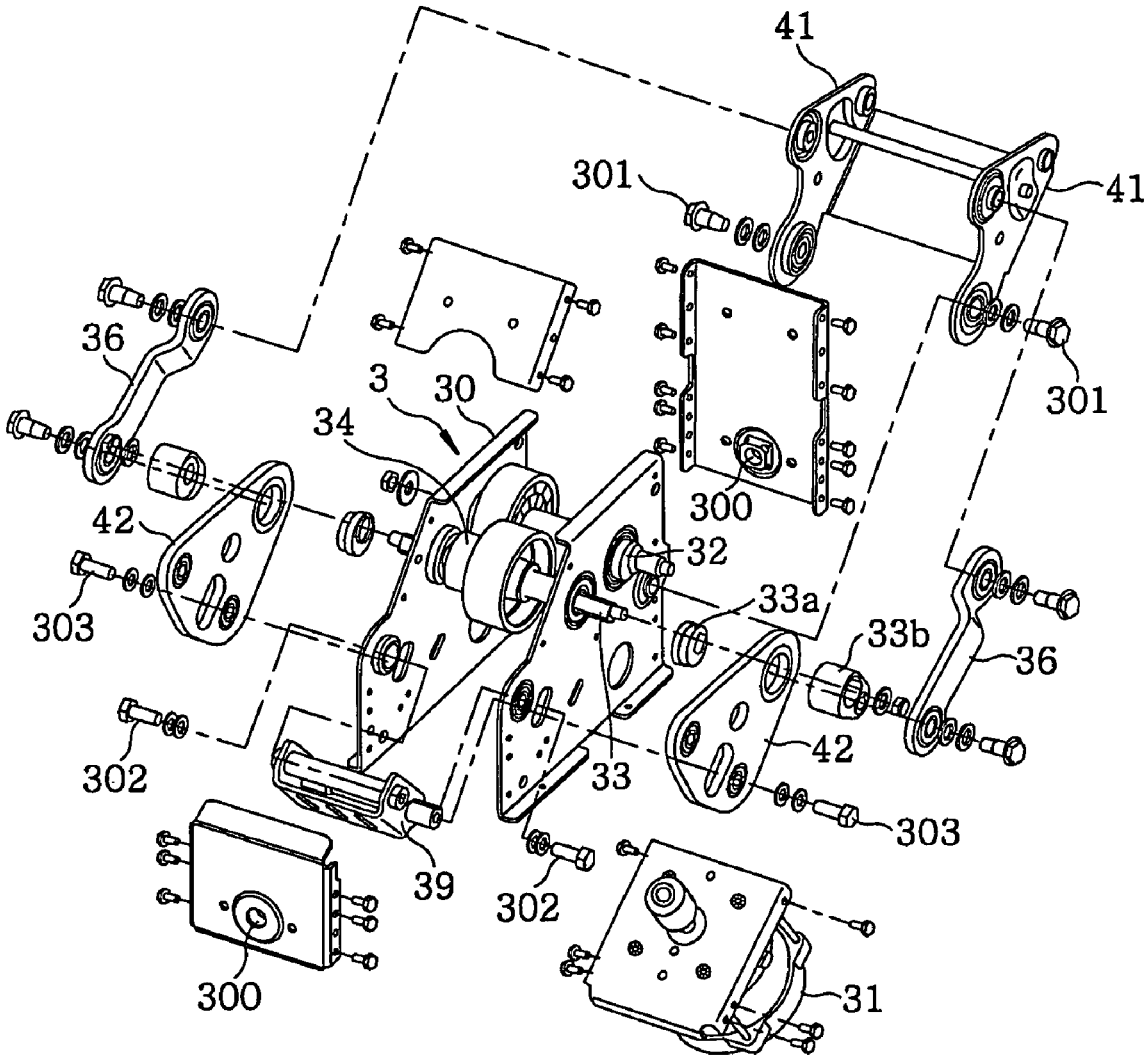
FIG. 10 is an exploded perspective view of the driving unit of the rocking type exercising apparatus.

Rotation of the off-centered portion of the output shaft 32 connected to the support frame 13 through the link 35 causes the movable frame 30 to reciprocatingly rotate about the shafts 130 (extending along the longitudinal axis A inclined in the forward/backward direction in FIG. 9).

Eccentric rotation of the off-centered portion 33*a* of the output shaft 33 causes the front end of the movable plate 40 to swing in the forward/backward and upward/downward directions through the intervention of the link plate 42 and the extensible/contractible actuator 45. Eccentric rotation of the off-centered portion 33*b* causes the rear end of the movable plate 40 to swing primarily in the forward/backward direction through the intervention of the connection link 36 and the link plate 41. Assuming that the trajectory of forward/backward swinging movement of a joint shaft 40*a* for joining the link plate 41 and the movable plate 40 together is T1 and the trajectory of forward/backward swinging movement of a joint shaft 40*b* for joining the extensible/contractible actuator 45 and the movable plate 40 together is T2 as illustrated in FIG. 9, the strokes of both swinging movement are set equal to each other but the upward/downward movement components are set differently in the trajectories T1 and T2.

In addition, although the trajectory T1 is mainly moved in the forward/backward direction, the trajectory T2 has an increased upward/downward movement component in addition to the forward/backward movement component. This is because the shaft 303 of the link plate 42 is located rearwardly of the shaft 40*b*. Furthermore, the trajectory T2 goes forward and comes back via different routes deviated in the upward/backward direction, because the rotating plate 39 constituting one of the constituent parts for driving rocking motion of the front end of the movable plate 40 changes the position of the shaft 303 as a rotational axis of the link plate 42 in the upward/backward direction.

In this connection, the seat frame 20 of the seat 2 is fixed to the movable plate 40 that makes a rocking motion in the forward/backward and leftward/rightward directions as the output shafts 32 and 33 are rotated, whereby the seat 2 rocks together with the movable plate 40 in the forward/backward and leftward/rightward directions. The revolution number of the output shafts 32 and 33 is set to ensure that two cycles of the forward/backward rocking motion are performed during one cycle of the leftward/rightward rocking motion. A center point 21*a* of the seat surface member 21 of the seat 2 is positioned at a center in the leftward/rightward direction and at lowermost in the forward/backward direction. Two cycles of forward/backward rocking motion are performed during one cycle of leftward/rightward rocking motion, so that the center point 21*a* is described in a figure eight pattern, when viewed from the top, during the forward/backward and leftward/rightward rocking motion of the seat 2 as illustrated in FIG. 1A.

Figure 1A:
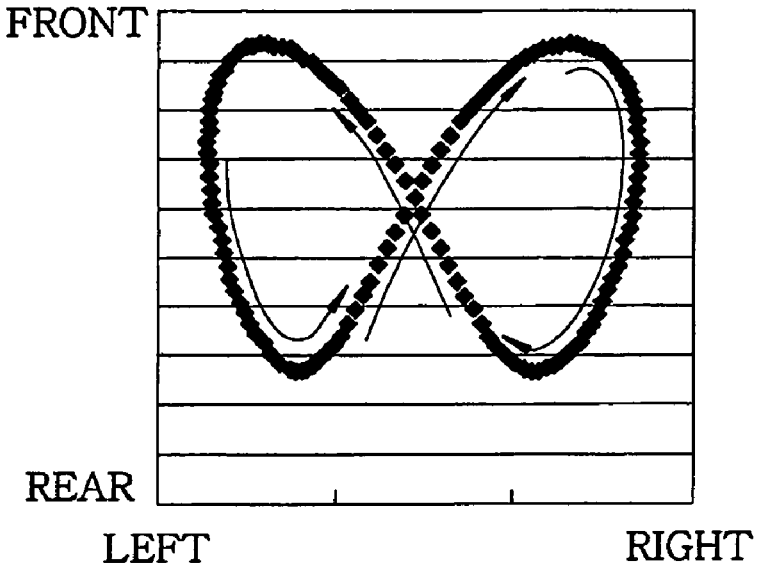
FIGS. 1A and 1B are views for explaining the operation of a rocking type exercising apparatus in accordance with one embodiment of the present.
Figure 1B:
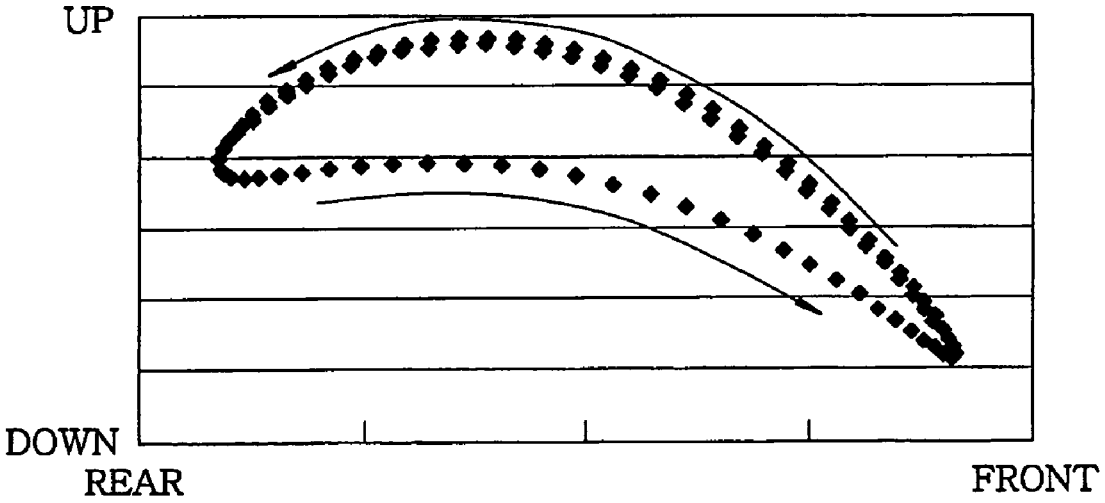

Due to the difference in the trajectories T1 and T2, the center point 21*a* of the seat 2 goes down while moving forward but goes up while coming back as illustrated in FIG. 1B.

Further, as illustrated above, the trajectory T1 of the rear end of the seat 2 signifies a forward/backward motion with a reduced upward/downward motion component, on the other hand, the trajectory T2 of the front end of the seat 2 stands for a forward/backward motion with an increased upward/downward motion component. Thus, the upward/downward motion of the seat 2 is performed in such a way that the front end is moved up and down with respect to the rear end. The user sitting on the seat 2 in a position substantially coinciding with the center point 21*a* of the seat 2 can accurately feel the motion of the seat 2, that is, the upward/downward movement of the front end with respect to the rear end lying behind the user.

FIGS. 1A and 1B are graphs obtained by plotting the movement of the center point 21*a* of the seat 2 at regular time intervals. In this graph, the section having a greater interval between dots signifies high speed movement and the section where a narrower interval is changed to a broader interval within a short period of time represents movement with increased acceleration. FIGS. 1A and 1B show that the acceleration at the forward motion is greater than the acceleration at the backward motion. A user, who sits on the seat 2 and takes the motions of the seat 2, feels a sense of forward movement. Therefore, the user can have a sense as if he or she enjoys actual horse riding.

The leftward/rightward rocking motion does not occur about a horizontal axis generally parallel to the movable plate 40 but about the longitudinal axis A whose front end is lower than its rear end. Accordingly, though the movable plate 40 performs a leftward/rightward rocking motion within an equal angular extent at the front and rear ends, the leftward/rightward stroke of the movable plate 40 at the front end is greater than the stroke at the rear end. This is because the vertical distance between the front end of the movable plate 40 and the longitudinal axis A is greater than the vertical distance between the rear end of the movable plate 40 and the longitudinal axis A. The forward/backward rocking motion (pitching) is combined with the leftward/rightward rocking motion (rolling). In the figure eight pattern trajectory as observed from the top, the leftward/rightward motion width at the front side becomes greater than that at the rear side as is apparent in FIG. 1A. Furthermore, the forward tilting motion includes a yawing motion component by which the front end of the seat 2 is obliquely twisted forward and moved criss-cross.

Therefore, the user, who sits on the seat 2 and takes all the motions of the seat 2, cannot maintain a balance unless he or she copes with the yawing motion as well as the pitching and rolling motions. This is quite effective from the standpoint of balance training.

The extensible/contractible actuator 45 of the driving unit 3 is provided for the purpose of changing the forward/backward inclination angle of the seat 2. In response to the manipulation of the operation panel 8, the extensible/contractible actuator 45 is extended and contracted to change over the forwardly inclined posture and the backwardly inclined posture. In addition, the extensible/contractible actuator 45 may be allowed to perform extending and contracting motions in concert with the forward/backward and leftward/rightward rocking motions, thereby increasing or decreasing the upward/downward motion component.

If the forward/backward inclination angle of the seat 2 is changed, so are the loads applied to individual muscles (abdominal muscles, back muscles, front-of-thigh muscles and back-of-thigh muscles) of the user during the rocking motion of the seat 2. The change in the rocking speed may also lead to a change in the load intensity and the ratio of the loads applied to the individual muscles. In order for the user to be clearly aware of such change, the status of loads applied to the respective muscles is displayed on the operation panel 8 as will be set forth later. The status of load is decided based on the data obtained in advance as to how the myogenic potentials of the respective muscles vary with the difference in the forward/backward inclination angle and the rocking speed of the seat 2.

When the user sits on the seat 2 and takes all the motions of the seat 2, the user can enjoy the rocking motion in a safer manner by resting the foot on the stirrup members 7 and holding the rein 6 with the hands. The stirrup members 7 are designed so that the joint point between the connection piece 72 and the foot rest 70 can be adjusted in the vertical direction. This makes it possible to set the height of the stirrup members 7 in conformity with the physique and preference of the user.

The connection piece 72 is made of an elastic material and is freely bendable to the left and right. As is clear from the right stirrup member 7 shown in FIG. 4, the foot rest 70 joined to the outer surface of the connection piece 72 has a bottom portion that extends outwardly upwardly at an inclination angle $\alpha$. By allowing the foot rest 70 to be off-set outwardly, it becomes easy for the user to rest the foot on the foot rest 70. Once the foot is rested on the foot rest 70 of each of the stirrup members 7, the elastic connection piece 72 is bent to have the foot rest 70 move inwardly, thereby bring the bottom portion of the foot rest 70 into a horizontal state as is apparent from the left stirrup member 7 shown in FIG. 4. Therefore, when the feet are placed on the stirrup members 7, it is possible for the user to maintain a good posture with no possibility that an exceedingly high force is applied to the ankles or the knees.

Figure 11:
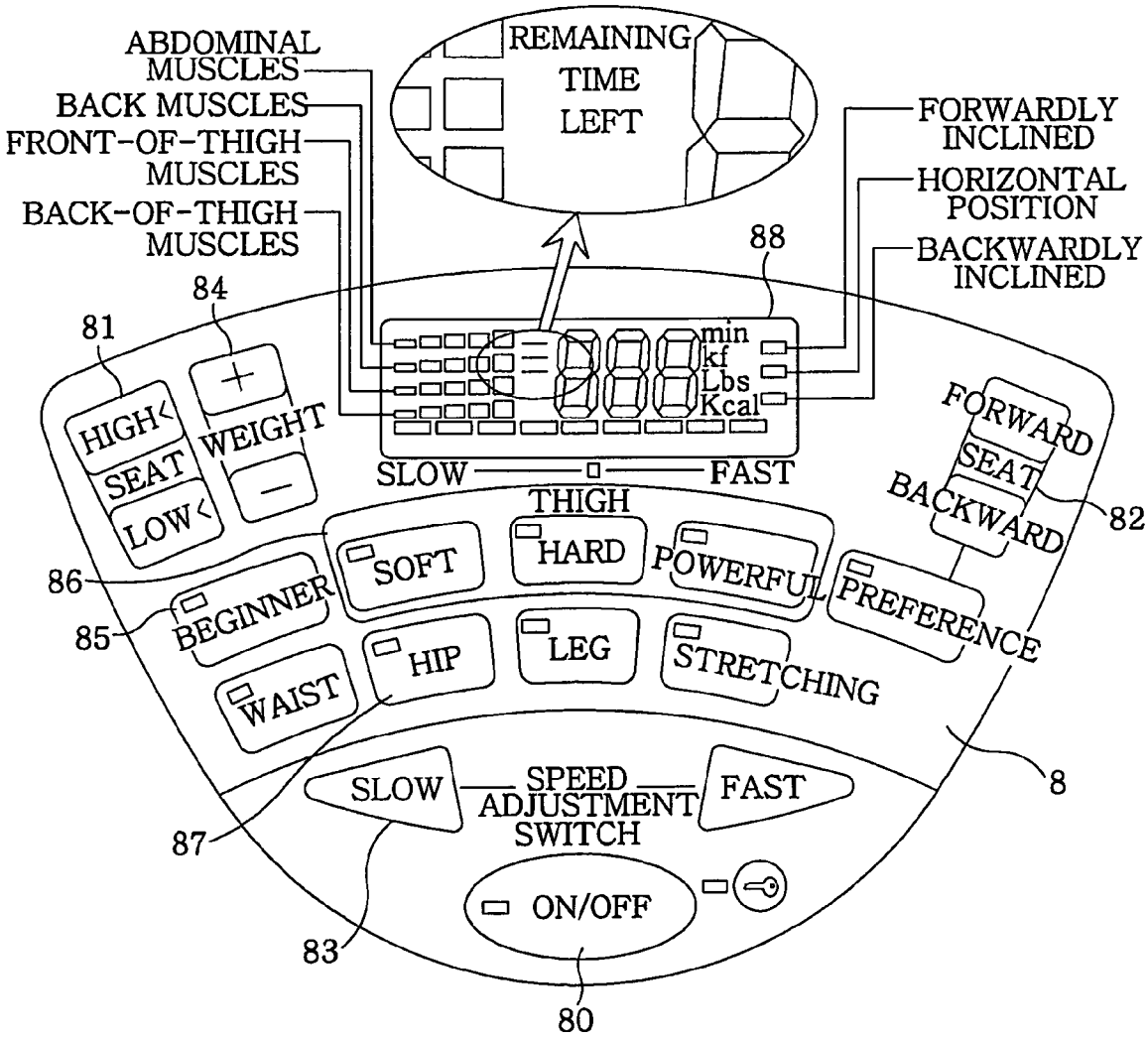
FIG. 11 is a front view showing an operation panel of the rocking type exercising apparatus.

FIG. 11 shows the operation panel 8 of arranged in the front end portion of the seat 2. In this figure, reference numeral 80 designates a power switch, reference numeral 81 is a height adjustment switch for operating the electrical sliding unit 14 to adjust the height of the seat 2, reference numeral 82 designates an angle adjustment switch for operating the extensible/contractible actuator 45 to adjust the inclination angle of the seat 2, and reference numeral 83 designates a speed adjustment switch for changing the rotational speed of the motor 31 of the driving unit 3 to control the rocking speed.

Reference numeral 84 designates an up/down switch for inputting the weight value of a user, reference numeral 85 designates an operation mode selection switch for selecting a rocking motion to be suitable for a beginner, reference numeral 86 designates an operation mode conversion switch for converting the intensity of an exercise offered by the rocking motion, reference numeral 87 designates an exercise target conversion switch for converting an exercise target, and reference numeral 88 designates a display formed of a liquid crystal panel. Upon operating the exercise target conversion switch 87, the forward/backward inclination angle of the seat 2 is suitably converted by means of the extensible/contractible actuator 45.

The display 88 serves to indicate the inclination status of the seat 2, the speed adjustment status, the operation time, the exercise intensity, the calculated exercise amount (consumed calories), and the loads to be applied to abdominal muscles, back muscles, front-of-thigh muscles and back-of-thigh muscles by the speed change and the change in the forward/backward inclination postures of the seat 2 resulting from extension and contraction of the extensible/contractible actuator 45. The exercise amount may be preferably calculated based on the rocking amount (data corresponding to the exercising amount per unit time) calculated in advance for respective forward/backward inclination postures and operation speeds of the seat 2, the inputted weight value, and the operation time. However, it may also be possible to install an acceleration sensor in the driving unit 3 or the seat 2 and calculate the exercise amount using acceleration data obtained from the acceleration sensor.

While the embodiment described above is directed to a rocking type exercising apparatus that allows a user to enjoy an exercise like horse riding, the present invention is not limited thereto. Alternatively, the present invention may be applicable to an apparatus of the type allowing a user to take an exercise like surfing for example by rocking a footrest on which the user stands. The present invention may also be applicable to an apparatus of the type enabling a user to take an exercise like walking by rocking a seat on which a user sits while individually moving up and down each of footrests on which each of the feet of the user is placed.

While the invention has been shown and described with respect to the embodiments, it will be understood by those skilled in the art that various changes and modifications may be made without departing from the scope of the invention as defined in the following claims.

What is claimed is:

1. A rocking exercising apparatus comprising:

a movable unit on which a user rides; and a driving unit for causing the movable unit to perform a rocking motion, wherein the driving unit is capable of driving the movable unit to rock in forward/backward directions of the user riding on the movable unit and capable of moving the movable unit forward at a greater acceleration than when the movable unit is moved backward;

wherein the driving unit includes a movable frame, a motor arranged within the movable frame, an output shaft to which torque of the motor is transferred, and a first and a second link plate for connecting the movable unit to the movable frame;

wherein the output shaft has a first and a second off-centered portion lying on an external surface of the movable frame;

wherein eccentric rotation of the first off-centered portion causes a front end of the movable unit to swing in the forward/backward directions through the second link plate; and wherein eccentric rotation of the second off-centered portion causes a rear end of the movable unit to swing in the forward/backward directions through the first link plate.

2. The rocking exercising apparatus of claim 1, wherein the driving unit is designed to rock the movable unit by using eccentric rotational output powers and to set an acceleration difference between forward movement and backward movement by using the eccentric rotations.

3. The rocking exercising apparatus of claim 1, wherein the first link plate is connected to the rear end of the movable unit and joined together with the movable unit by a first joint shaft, and the second link plate is connected to the front end of the movable unit through an extensible/contractible actuator joined together with the movable unit by a second joint shaft.

4. The rocking exercising apparatus of claim 1, wherein the first off-centered portion is connected to the second link plate and the second off-centered portion is connected to one end of a connection link of which the other end is connected to the first link plate.

5. The rocking exercising apparatus of claim 3, wherein the eccentric rotation of the first off-centered portion causes the front end of the movable unit to swing in the forward/backward directions through the second link plate and the extensible/contractible actuator.

6. The rocking exercising apparatus of claim 4, wherein the eccentric rotation of the second off-centered portion causes the rear end of the movable unit to swing in the forward/backward directions through the connection link and the first link plate.

7. The rocking exercising apparatus of claim 1, wherein the first off-centered portion has reduced eccentricity, while the second off-centered portion has increased eccentricity.

* * * * *